US010328565B2

(12) United States Patent
Moessnang et al.

(10) Patent No.: US 10,328,565 B2
(45) Date of Patent: Jun. 25, 2019

(54) PORTABLE POWER TOOL

(71) Applicant: Hilti Aktiengesellschaft, Schaan (LI)

(72) Inventors: Franz Moessnang, Stadtbergen (DE); Markus Hartmann, Mauerstetten (DE); Manfred Ludwig, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 440 days.

(21) Appl. No.: 14/915,728

(22) PCT Filed: Sep. 2, 2014

(86) PCT No.: PCT/EP2014/068566
§ 371 (c)(1),
(2) Date: Mar. 1, 2016

(87) PCT Pub. No.: WO2015/028678
PCT Pub. Date: Mar. 5, 2015

(65) Prior Publication Data

US 2016/0199971 A1 Jul. 14, 2016

(30) Foreign Application Priority Data

Sep. 2, 2013 (EP) ..... 13182607

(51) Int. Cl.
*B25F 5/00* (2006.01)

(52) U.S. Cl.
CPC ..... *B25F 5/001* (2013.01); *B25D 2250/261* (2013.01)

(58) Field of Classification Search
CPC ..... B25D 2250/261; B25F 5/001; B25F 5/00; B25F 5/008; B25F 5/02
(Continued)

(56) References Cited

U.S. PATENT DOCUMENTS 6,186,709 B1 2/2001 Hsu
6,520,267 B2 * 2/2003 Funfer ..... B25D 16/006 173/170
(Continued)

FOREIGN PATENT DOCUMENTS

CN 1419997 A 5/2003
CN 201783922 U 4/2011
(Continued)

OTHER PUBLICATIONS

PCT/EP2014/068566, International Search Report (PCT/ISA/210) dated Oct. 14, 2014 (Two (2) pages).
(Continued)

*Primary Examiner* — Andrew M Tecco
*Assistant Examiner* — Nicholas E Igbokwe
(74) *Attorney, Agent, or Firm* — Crowell & Moring LLP

(57) ABSTRACT

A portable power tool is disclosed. The tool has a tool holder, a motor, a switchable gear stage, and a slider. The gear stage has a gear element movable in a switching direction with a toothing, which in a first gear position is engaged with a corresponding toothing and in a second gear position is disengaged. The slider is displaceable between first and second switch positions where the first switch position is allocated to the first gear position and the second switch position is allocated to the second gear position. A coupling device has a carriage movable in the switching direction and a catch. The carriage is connected to the gear element and the catch is latched in the first and second gear positions. A spring element has springy first and second sections. The slider has a finger that is arranged along the switching axis between the sections.

8 Claims, 3 Drawing Sheets

(58) Field of Classification Search
USPC ..... 173/170, 213, 216; 310/50
See application file for complete search history.

(56) References Cited

U.S. PATENT DOCUMENTS

| | | | | |
|---|---|---|---|---|
| 7,607,493 | B2 * | 10/2009 | Erhardt | B25D 16/006 173/216 |
| 2004/0020669 | A1 | 2/2004 | Spielmann et al. | |
| 2005/0109137 | A1 * | 5/2005 | Hartmann | B23D 51/16 74/25 |
| 2006/0090913 | A1 * | 5/2006 | Furuta | B25B 21/00 173/48 |
| 2006/0108133 | A1 * | 5/2006 | Yamazaki | B25D 11/005 173/104 |
| 2008/0098842 | A1 * | 5/2008 | Spielmann | B25F 5/001 74/473.1 |
| 2010/0163261 | A1 * | 7/2010 | Tomayko | B23B 45/008 173/47 |
| 2011/0079408 | A1 * | 4/2011 | Grunwald | B23B 45/008 173/47 |
| 2011/0147021 | A1 * | 6/2011 | Schaal | B25D 16/00 173/47 |
| 2012/0145427 | A1 * | 6/2012 | Fuchs | B23B 45/001 173/216 |
| 2012/0318548 | A1 | 12/2012 | Hirabayashi et al. | |
| 2013/0025899 | A1 * | 1/2013 | Kuehne | B25F 5/001 173/216 |
| 2013/0161040 | A1 | 6/2013 | Tomayko et al. | |
| 2013/0220655 | A1 * | 8/2013 | Tomayko | B25F 5/001 173/47 |
| 2013/0267374 | A1 * | 10/2013 | Blum | F16H 3/44 475/299 |
| 2016/0250742 | A1 | 9/2016 | Kuehne | |

FOREIGN PATENT DOCUMENTS

| | | | |
|---|---|---|---|
| CN | 102825583 | A | 12/2012 |
| CN | 202833889 | U | 3/2013 |
| DE | 10 2010 041 172 | A1 | 3/2012 |
| EP | 1 632 314 | A2 | 3/2006 |
| EP | 2 184 138 | A2 | 5/2010 |
| EP | 2 551 064 | A2 | 1/2013 |
| GB | 2 383 387 | A | 6/2003 |

OTHER PUBLICATIONS

English translation of Chinese-language Office Action issued in counterpart Chinese Application No. 201480048427.7 dated Sep. 29, 2016 (Eight (8) pages).

* cited by examiner

PORTABLE POWER TOOL

This application claims the priority of International Application No. PCT/EP2014/068566, filed Sep. 2, 2014, and European Patent Document No. 13182607.5, filed Sep. 2, 2013, the disclosures of which are expressly incorporated by reference herein.

BACKGROUND AND SUMMARY OF THE INVENTION

The present invention relates to a portable power tool, e.g., an electric screwdriver, a hammer drill, which is equipped with a manually switchable gear unit.

The portable power tool has a tool holder for receiving a tool, a motor, at least one switchable gear stage, and a slider. The gear stage couples the motor in a driving manner to the tool holder. The gear stage has a gear element, which is movable in a switching direction, with a toothing, which in a first gear position is engaged with a corresponding toothing, and which in a second gear position is disengaged from the corresponding toothing. The slider can be displaced by a user between at least a first switch position and a second switch position in the switching direction, wherein the first switch position is assigned to the first gear position and the second switch position is assigned to the second gear position. The slider has a finger. A coupling device has a carriage that is movable in the switching direction and a catch for the carriage to a housing. The carriage is connected to the movable gear element. The catch latches in the first gear position and the second gear position, and the catch is not latched in positions between the first gear position and the second gear position. The first and second gear positions are directly adjoining so to speak. The carriage is moved on the path between the two gear positions, but is not meant to come to a stop on it. A spring element has a springy first section and a springy second section, wherein both sections each have an end attached to the carriage and an end that is movable relative to the carriage. The finger is arranged along the switching axis between the sections.

The coupling device conveys the actuation of the slider to the gear element. The coupling device advantageously prevents the gear element from stopping on the path between two gear positions, even if the user pushes the slider in a position between two gear positions. In addition, the coupling device prevents damaging the gear element, since the user cannot forcibly push it out of or in engagement with a toothing in the event of blocking.

DETAILED DESCRIPTION OF THE DRAWINGS

Figure 1:
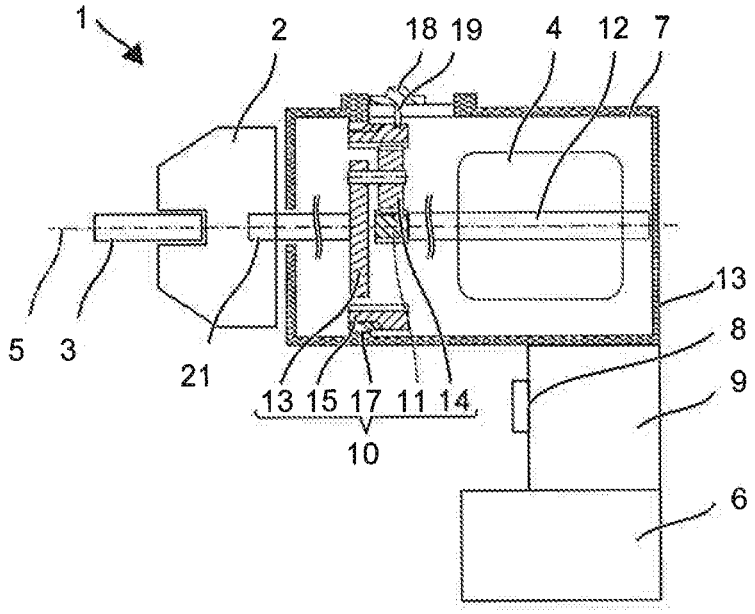
FIGS. 1, 2 depict an electric screwdriver.

Identical elements or those having similar functions are indicated in the drawings by means of identical reference signs, unless stated otherwise.

Figure 2:
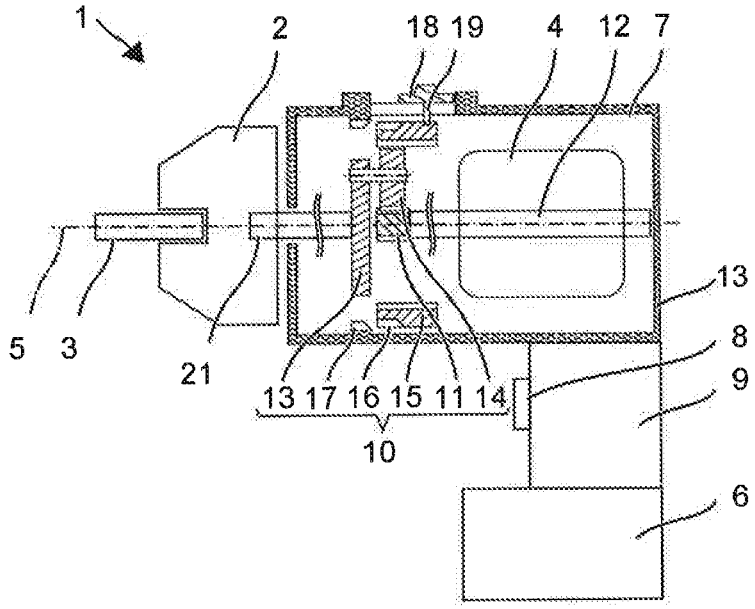

FIGS. 1 and 2 schematically depict an electrical screwdriver 1 as an example of a portable power tool. The electric screwdriver has a tool holder 2, into which a tool 3, e.g., a screwdriver bit, a drill bit 3, can be inserted. An electrical motor 4 drives the tool holder 2 about its work axis 5. The electrical power supply of electric motor 4 may come from a battery 6, which is removably attached to a housing 7 of electrical screwdriver 1. The user can operate the portable power tool with a system button 8 and control it during operation by means of a handgrip 9.

Electric screwdriver 1 is provided with a switchable gear stage 10. Model gear stage 10 allows users to select between two different gear reductions. Model gear stage 10 has a drive-side sun gear 11, which is coupled to drive shaft 12 of motor 4. Planetary gears 14 arranged on planetary carrier 13 mesh with sun gear 11. A gear ring 15 also engages with planetary gears 14. Gear ring 15 can be displaced along working axis 5 between two provided gear positions. Gear ring 15 is coupled in a first gear position, for example purposes, in a rotationally rigid manner with housing 7 (FIG. 1) and in a second gear position in a freely rotating manner relative to the housing (FIG. 2). For example, housing 7 has a radial toothing 16, which engages in a corresponding toothing 17 of gear ring 15. In the second gear position, gear ring 15 can be rotated relative to housing 7 about working axis 5. Toothing 16, 17 is detached.

A slider 18 is provided externally on housing 7. Slider 18 is connected via a coupling device 19 to gear ring 15. The user can displace slider 18 along a switching axis 20 between a first switch position and a second switch position, which are each assigned to one of the gear positions of gear ring 15. Coupling device 19 ensures that gear ring 15 only occupies the provided gear positions and cannot remain on the path between gear positions. In addition, coupling device 19 enables one to uncouple the switch position of slider 18 and the gear position of gear ring 15 on an intermittent basis. For example, slider 18 can already be actuated when the current angle setting of gear ring 15 inhibits its toothing 16 to be pushed on toothing 17 of housing 7.

Figure 3:
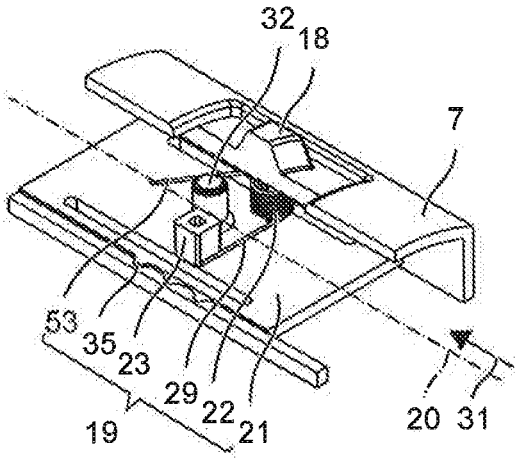
FIG. 3 depicts a switching device during a change of a gear position.
Figure 4:
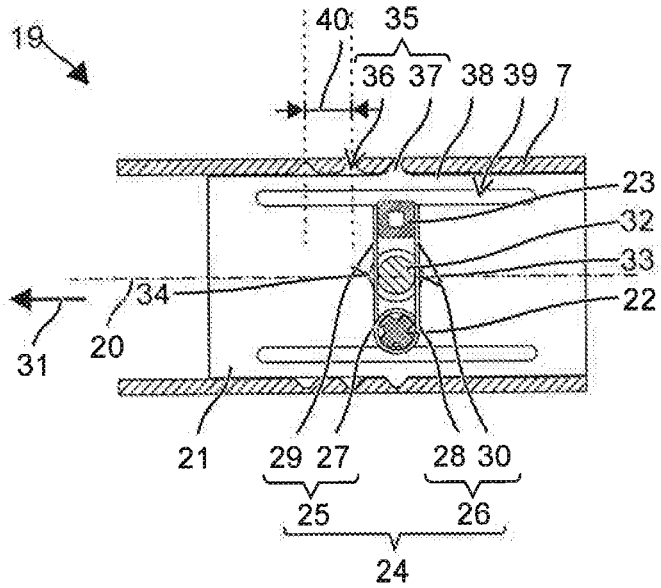
FIG. 4 depicts a coupling part of the switching device after the change has occurred.

Slider 18 and coupling device 19 are depicted in FIG. 3 as an isometric section, in which slider 18 is in a changed switch position and gear ring 15 with the gear position has not yet ensued. FIG. 4 depicts coupling device 19 in a matched switch position and gear position.

Coupling device 19 has a carriage 21, which can be moved parallel to slider 18. Carriage 21 is preferably rigidly connected to the gear element to be moved, in this case gear ring 15. The alignment of slider 18 and carriage 21 is thus preferably oriented to switching axis 20 of the gear element.

Carriage 21 is equipped with two pins 22, 23. First pin 22 is offset relative to second pin 23 transversely to switching axis 20. On first pin 22, there is fitted a coil spring 24 with two protruding arms 25, 26. Arms 25, 26 thus each have an end 27, 28 attached to first pin 22 and a free end 29, 30. Arms 25, 26 are permanently affixed with one of their ends 27, 28 to first pin 22. The two arms 25, 26 extend from first pin 22 to second pin 23. The free ends 29, 30 of arms 25, 26 contact second pin 23 in such a manner that pin 23 is arranged along switching axis 20 between the two arms 25, 26. The one arm 25 contacts one side of pin 23, which points in one switching direction 31, and the other arm 26 contacts a side of pin 23, which points opposite switching direction 31. Arms 25, 26 may be pressed on to second pin 22 in a preloaded manner.

Slider 18 has a finger 32, which engages between both arms 25, 26. Finger 32 thus lies in switching direction 31 in front of one arm 25 and after the other arm 26. Arms 25, 26 contact opposing sides 33, 34 of finger 32. Finger 32 and the two pins 22, 23 lie in one line when gear position of slider 18 matches the switch position of gear ring 15. In the depicted embodiment, finger 32 is arranged between first pin 22 and second pin 23. If slider 18 is deflected out of a switch position into switching direction 31, an offset of finger 32, relative to second pin 22, results parallel to switching axis 20. Finger 32 deflects one of the two arms 25 in switching direction 31, while the other arm 26, impeded by the second pin 23, does not follow the deflection of the one arm 25. Both arms 25, 26 are consequently pressed apart against their spring force. On carriage 21, a switching force exerted by coil spring 24 acts in switching direction 31. Carriage 21 follows the movement of slider 18, by which pins 22, 23 come back in line with finger 32 and the spring force is minimized.

The construction with coil spring 24 is simple to execute, among other things because coil spring 24 can be obtained as a common standard product and installation of coil spring 24 is simple to accomplish. Second pin 23 is advantageous because it prevents a swiveling of the entire coil spring 24 about first pin 22. Coil spring 24 can thereby be seated rotatably on first pin 22. Alternatively, coil spring 24 is secured against swiveling or turning about first pin 22, and second pin 23 can be omitted.

Carriage 21 has a catch 35 with housing 7. Catch 35 engages each time when carriage 21 or the gear element has reached the intended gear position. Catch 35 requires that a pushing force acting on carriage 21 along switching axis 20 must exceed a threshold value so that carriage 21 is moved out of a gear position. Model catch 35 contains multiple recesses 36, depending on the number of gear positions, which are formed one after the other along switching axis 20 in housing 7. The spacing of the recesses 36 corresponds to the spacing of the gear positions. Carriage 21 has a projection 37, protruding transversely to switching axis 20, which engages in one of the recesses 36. Recesses 36 and projection 37 have sides preferably inclined to switching axis 20. Due to the sides, projection 37 is pressed out of recess 36 given a sufficient pushing force along switching axis 20. Projection 37 can be arranged on a spring 38, against whose spring force projection 37 can be deflected out of recess 36. Spring 38 can be executed for example by a slit 39, adjoining projection 37 in the deflection direction, in carriage 21.

The switching force exerted by coil spring 24 must overcome the threshold value specified by catch 35 before carriage 21 can follow the movement of slider 18. The threshold value is preferably selected in such a manner that carriage 21 first moves when the switching force drives carriage 21 to the next catching position, i.e., gear position. The threshold value lies between 50% and 100% of a switching force, e.g., between 75% and 90%, which coil spring 24 produces given an offset between slider 18 and carriage 21 equal to distance 40 between gear positions, e.g., recesses 36. The distances between the gear positions of slider 18 are preferably equal to distances 40 between the gear positions. A user can preferably push slider 18 somewhat, e.g., 10% to 40% of distance 40, out over a switch position to activate a switch process. Carriage 21 jumps into the next gear position and catches in it. As soon as the user releases slide 18, the remaining switching force ensures the return of slider 18. The threshold value can be adjusted by the spring force of spring 38 and the shape of the sides of projection 37 or recesses 36.

Figure 5:
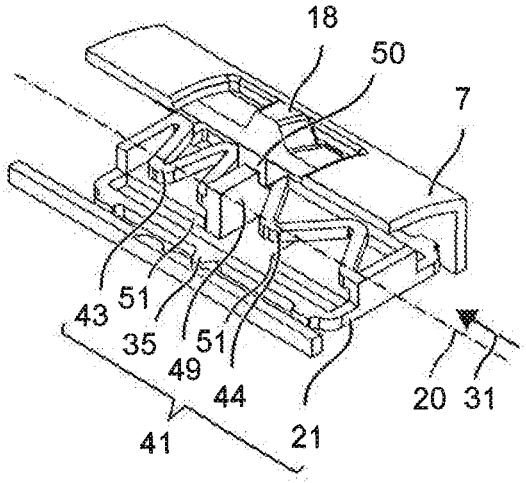
FIG. 5 depicts a switching device during a change of a gear position.
Figure 6:
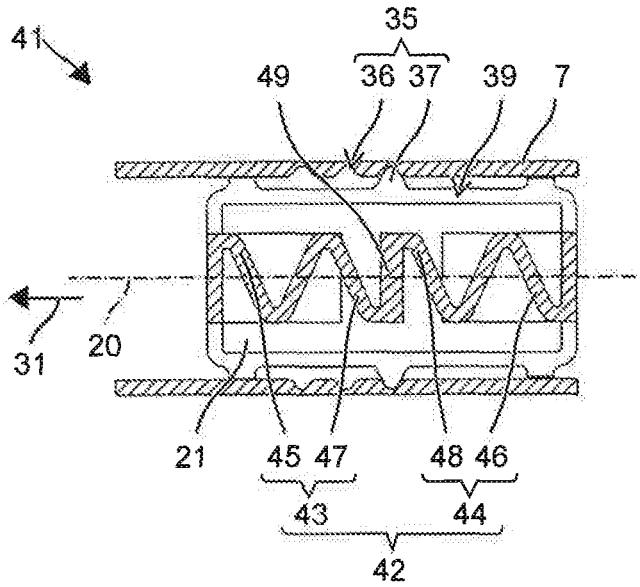
FIG. 6 depicts a coupling part of the switching device after the change has occurred.

Slider 18 and a different coupling device 41 are depicted in FIG. 5 as an isometric section, in which slider 18 is in a changed switch position and gear ring 15 with the gear position has not yet ensued. FIG. 4 depicts coupling device 41 when the switch position and gear position match.

Slider 18 and catch 35 of carriage 21 to housing 7 are identical to the design described relating to FIGS. 3 and 4, which is why these are referred to.

Carriage 21 has a spring element 42 with two springy sections 43, 44 folded along switching axis 20. The two folded sections 43, 44 are arranged one after the other parallel to switching axis 20. Each of the sections 43, 44 has an end 45, 46, which is attached to carriage 21. The respective other end 47, 48 of the folded sections 43, 44 is free relative to carriage 21. The two free ends 47, 48 lie along switching axis 20 between the two attached ends 45, 46 preferably in the center. The two free ends 47, 48 are connected to each other. A runner 49 can be mounted on the two free ends 47, 48 in a manner that connects these. Runner 49 is movable relative to carriage 21 along switching axis 20. Carriage 21 and spring element 42 are preferably designed in one piece. Consequently, carriage 21 and spring element 42 are continuously out of the same material and without connecting joints.

Slider 18 is connected to the center of spring element 42, e.g., runner 49. Slider 18 can have a rider 50, which encompasses runner 49 in a form-fitting manner. Runner 49 and rider 50 form a two-part counter-piece to finger 32 of the preceding embodiment. Carriage 21 can be preassembled; slider 18 is placed with rider 50 on runner 49. When displacing slider 18 in switching direction 31, spring element 42 is preloaded, front section 44 is under load in switching direction 31, and rear section 43 is compressed in switching direction 31. The resulting spring force serves as the switching force for carriage 21.

Carriage 21 may have stops 51, which limit a relative offset of runner 49 in relation to its rest position on carriage 21. Carriage 21 preferably comes into contact with one of the stops 51 when the offset is greater than 150% of distance 40 of the gear positions. This offset results from a pushing of slider 18 by more than 150% out of one of the switch positions in whose associated gear position carriage 21 remains. For example, toothing 17 may be blocked. To prevent damage to the folded sections 43, 44, these are uncoupled from runner 49 by stop 51.

The invention claimed is:

1. A portable power tool, comprising:

a tool holder;

a motor;

a switchable gear stage which couples the motor to the tool holder, wherein the switchable gear stage includes a gear element that is movable in a switching direction with a first toothing, which in a first gear position is engaged with a corresponding second toothing and which in a second gear position is disengaged from the corresponding second toothing;

a finger attached to a slider, wherein the slider is displaceable by a user between a first switch position and a second switch position in the switching direction, wherein the first switch position is assigned to the first gear position and the second switch position is assigned to the second gear position;

a coupling device which has a carriage that is movable in the switching direction and a catch, wherein the carriage is connected to the gear element and wherein the catch latches in the first gear position and the second gear position and does not latch in positions between the first gear position and the second gear position; and a spring element which includes a springy first section and a springy second section, wherein both of the springy first section and the springy second section each have a first end attached to the carriage and a second end movable relative to the carriage, and wherein the finger is disposed along a switching axis between the springy first section and the springy second section;

wherein the catch inhibits a movement of the carriage until the finger is deflected out of the first switch position or the second switch position by at least 50% of a distance between the first gear position and the second gear position.

2. The portable power tool according to claim 1, wherein the finger is connected in a force-fitting or a material-bonded manner to the respective second ends of the springy first section and the springy second section.

3. The portable power tool according to claim 1, wherein the springy first section and the springy second section are equally tensioned when the finger is in one of the first switch position and the second switch position and the carriage is in the respective gear position assigned to the one of the first switch position and the second switch position.

4. The portable power tool according to claim 1, wherein the catch includes a springy projection mounted on the carriage and a plurality of recesses, offset by a respective distance, in the housing along the switching direction.

5. The portable power tool according to claim 4, wherein the carriage includes a springy fixed joint which is formed by a slit in the carriage and wherein the springy projection is disposed on the springy fixed joint.

6. The portable power tool according to claim 1, wherein the spring element is a coil spring and wherein the springy first section and the springy second section are respective protruding arms of the coil spring and wherein the coil spring is mounted on the carriage.

7. The portable power tool according to claim 1, wherein the spring element has folded sections formed out of a plastic.

8. The portable power tool according to claim 7, wherein the carriage and the spring element are formed out of a seamlessly joined plastic body.

* * * * *